United States Patent [19]

Basler et al.

[11] Patent Number: 4,660,132

[45] Date of Patent: Apr. 21, 1987

[54] COOLING DEVICE FOR MOUNTING AND PROTECTING AN OPTICAL ELEMENT

[75] Inventors: Bradley S. Basler, Redwood City; Douglas H. Harrison, Los Altos, both of Calif.

[73] Assignee: Pindar Development Corporation, Sunnyvale, Calif.

[21] Appl. No.: 847,692

[22] Filed: Apr. 3, 1986

[51] Int. Cl.[4] ..... F21V 29/00; F21V 9/14

[52] U.S. Cl. ..... 362/294; 362/19; 362/373; 165/47; 165/104.33; 165/78; 165/185

[58] Field of Search ..... 362/294, 373, 19; 165/47, 104.33, 78, 185

[56] References Cited

U.S. PATENT DOCUMENTS

| | | | |
|---|---|---|---|
| 2,286,783 | 6/1942 | Barthel et al. | 362/294 |
| 2,312,561 | 3/1943 | Leonard | 362/294 |
| 3,202,070 | 8/1965 | Pratt, Jr. et al. | 362/294 |
| 3,400,995 | 9/1968 | Borberg et al. | 362/294 |
| 4,411,516 | 10/1983 | Adachi et al. | 362/294 |

FOREIGN PATENT DOCUMENTS

| | | | |
|---|---|---|---|
| 8301851 | 12/1984 | Netherlands | 362/294 |
| 528424 | 10/1976 | U.S.S.R. | 362/294 |

*Primary Examiner*—Albert W. Davis, Jr.

*Attorney, Agent, or Firm*—Limbach, Limbach & Sutton

[57] ABSTRACT

A cooling device for protecting a light absorbing optical element is provided. The cooling device includes an optical unit which comprises a transparent, thermally-conductive material disposed in heat conductive relation to the optical element. A mounting body supports the optical unit and receives heat energy therefrom. A heat pipe is mounted in the mounting body. Thus, heat energy is removed from the optical element and transferred to ambient through the thermally-conductive material, the mounting body and the heat pipe.

9 Claims, 9 Drawing Figures

FIG_1
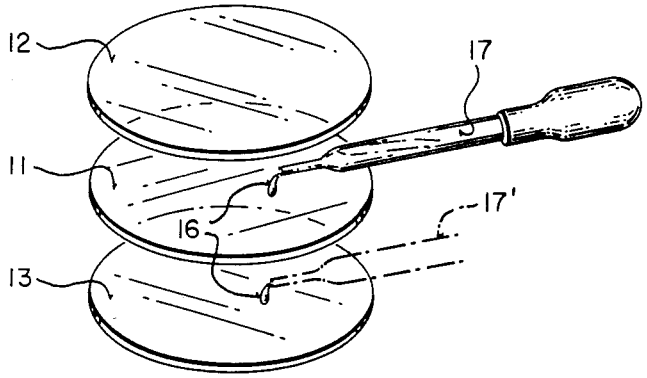
FIG_2
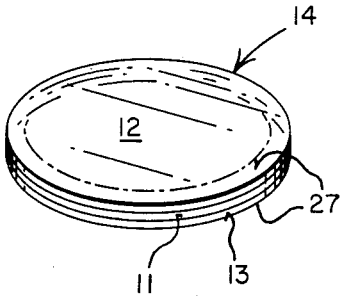
FIG_3
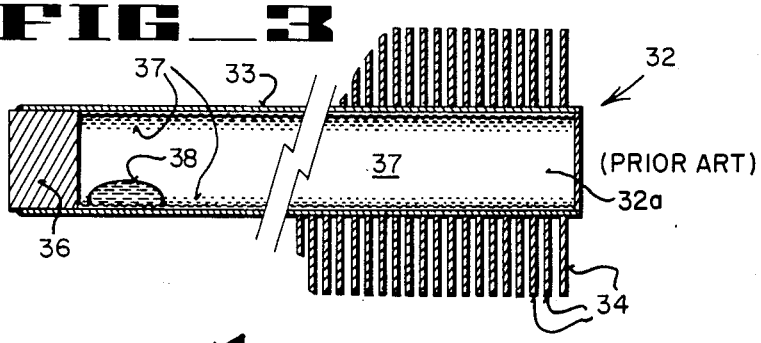
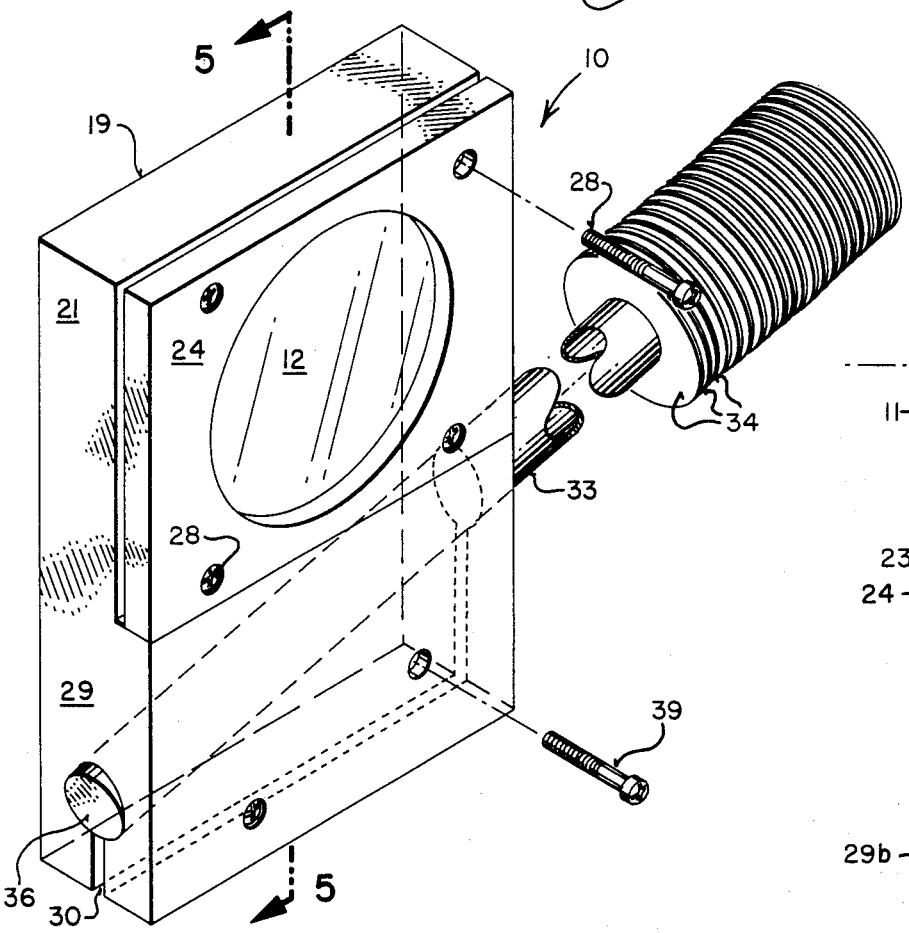
FIG_4
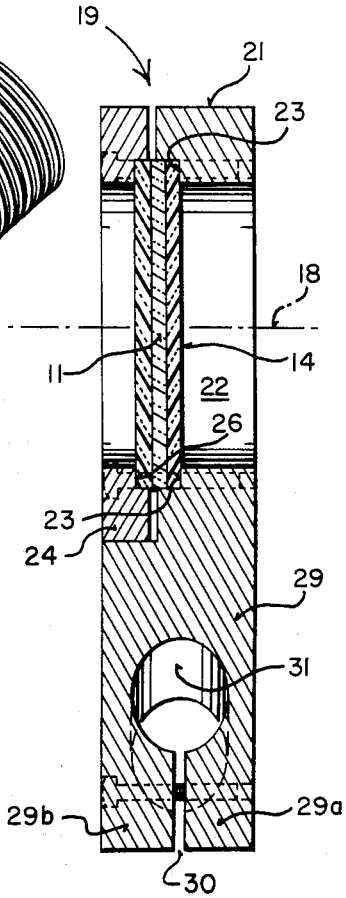
FIG_5

FIG_6
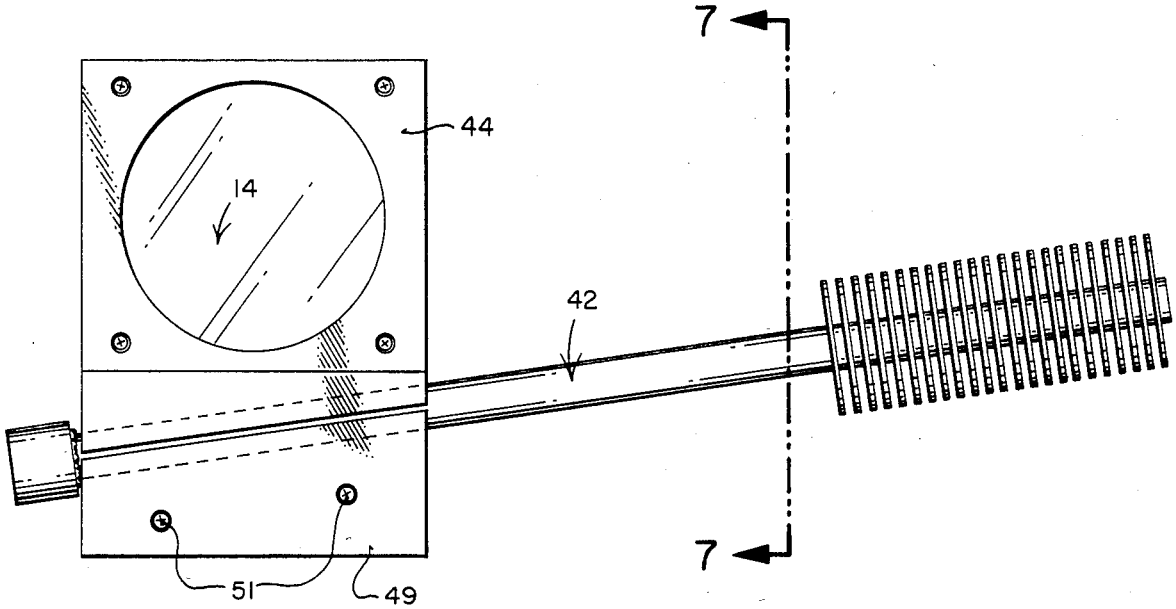
FIG_7
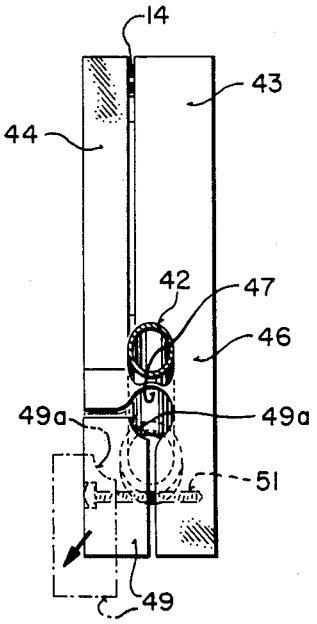
FIG_8
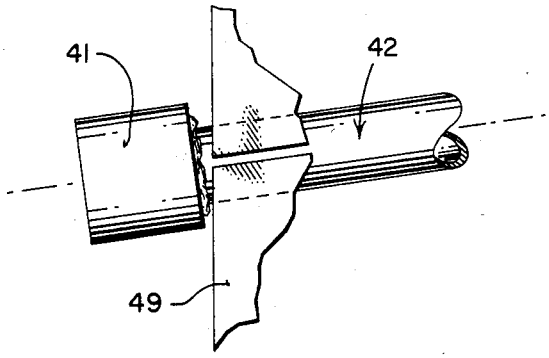
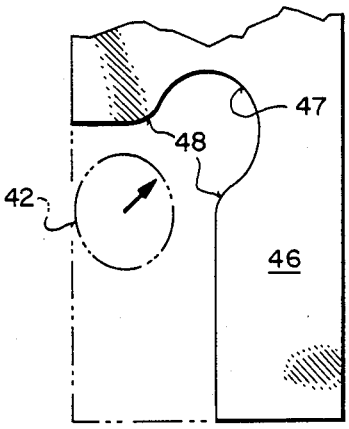
FIG_9

COOLING DEVICE FOR MOUNTING AND PROTECTING AN OPTICAL ELEMENT

This invention pertains to cooling means for mounting and protecting an energy absorbing optical element for the element to be subjected to a high power beam of energy, such as the light from the power beam of an optical projector.

In certain optical projection systems employing polarizing elements which absorb substantial amounts of light energy transmitted thereto, the polarizer element can be severely damaged by heat resulting from absorbing substantial energy from a high power light beam.

SUMMARY OF THE INVENTION AND OBJECTS

The present invention provides a cooling device for protecting a light absorbing optical element, such as a polarizing filter, which becomes heated when subjected to a beam of light. In the preferred embodiment of the invention, the cooling device includes an optical unit comprising a pair of sapphire windows with a thin polarizing filter disposed between the sapphire such that heat energy is transferred from the filter to the sapphire. An aluminum mounting body supports the optical unit and receives heat energy from the sapphire. A conventional heat pipe is mounted with its tube portion disposed within the mounting body and its fin portion exposed to ambient. Thus, in accordance with the present invention, heat energy is removed from the polarizing filter and transferred to ambient via the sapphire, the aluminum mounting body and the heat pipe.

In general, it is an object of the present invention to provide a simplified, improved means for mounting and cooling an energy absorbing optical element to permit the element to be subjected to high power energy.

Another object of the invention is to provide an energy dissipating device for safely cooling a polarizing element when the element would otherwise absorb sufficient light energy as would likely damage the element.

A further object of the invention is to provide a simplified means for mounting a heat exchange unit in effective heat transfer relation to a heat sink for cooling an energy absorbing optical element.

The foregoing and other objects of the invention will become more readily evident from the following detailed description of preferred embodiments when considered in conjunction with the drawings.

BRIEF DESCRIPTION OF THE DRAWINGS

FIG. 1 shows a diagrammatic perspective exploded view of a detail of an optical unit to be carried by the cooling device according to the invention;

FIG. 2 shows an assembly view of an optical unit as shown in FIG. 1;

FIG. 3 shows an elevation centerline section view of a heat tube structure for use in conjunction with the invention;

FIG. 4 shows a diagrammatic perspective view of a cooling device for mounting and protecting an optical element according to the invention;

FIG. 5 shows an elevation section view taken along the line 5—5 of FIG. 4;

FIG. 6 shows a diagrammatic front elevation view of a cooling device for protecting an optical element according to another embodiment of the invention;

FIG. 7 shows a side elevation section view of the embodiment shown in FIG. 6 taken along the line 7—7 thereof;

FIG. 8 shows a side elevation diagrammatic view in enlarged detail of an end of the heat tube assembly shown in FIG. 6; and FIG. 9 shows an enlarged detail view of a portion of FIG. 7, for clarity.

DETAILED DESCRIPTION OF PREFERRED EMBODIMENTS

A primary application for the cooling device 10 is the protection of a thin polarizing sheet 11, for example, on the order of 0.030 inches thickness, which is required to absorb something on the order of 85 watts while not exceeding a maximum temperature of 165° F., or 74° C. Polarizing element 11 is disposed to be captured between a pair of sapphire windows 12, 13 to form a polarizing optical unit 14. The sapphire windows should be cut so as to minimize their contribution to polarization effects due to birefringence. In order to establish intimate contact between the faces of polarizing element 11 and windows 12, 13, a drop 16 of index matching oil is applied between the confronting surfaces. It has been observed that in this manner the spacing between polarizing element 11 and its associated sapphire windows 12, 13 can be on the order of one wave length of light when moderately pressed together. Thus, as shown in FIG. 1, a pipette 17 is shown in full lines dispensing one of the two drops 16 and in phantom lines dispensing the other drop.

A mounting and cooling device 10 supports unit 14 in an optical path 18 comprises a mounting body 19 of a material which is readily heat conducting, such as aluminum. Body 19 includes a first body portion 21 for supporting and mounting unit 14 in heat conductive relation thereto for dissipating heat energy from element 11 as now to be described.

Body portion 21 includes a cylindrical opening 22 formed to include first and second diameters providing a stepped sidewall so as to form a recessed shoulder 23. The broader end of opening 22 receives unit 14 inserted partially therein, and forming an interference fit therewith.

A retaining plate 24 formed with a cylindrical opening in alignment with opening 22 includes a recessed shoulder 26 forming a pocket to receive the other side of unit 14. Shoulders 23, 26 respectively engage the annular edge margins 27 (FIG. 2) of unit 14. Suitable means such as screws 28 serve to draw plate 24 against unit 14 so as to compress same slightly between shoulders 23, 26 to provide good heat conductivity between body portion 21 and windows 12, 13 for withdrawing heat from element 11.

Mounting body 19 further includes a second body portion 29 forming a heat sink for absorbing heat energy from the first body portion 21. Means carried by heat sink portion 29 dissipates heat energy therefrom to the environment as now to be described. An upwardly sloping open mounting housing 31 lying substantially in a midplane of heat sink portion 29 carries a heat tube assembly 32 disposed in intimate contact with the interior periphery of housing 31 in a manner to receive heat from the heat sink.

Thus, as shown in FIG. 2 a heat tube assembly 32 includes a thin walled cylindrical tubing 33 of readily heat conductive material such as copper. Tubing 33 carries a number of thin heat exchange fins 34 carried by the outer sidewall of tubing 33. Thee adjacent end of tubing 33 as formed is closed, whereas the other end of tubing 33 is closed by means of a plug 36. The interior sidewall of tubing 33 carries a metal floss material which is a woven mesh primarily of copper or other suitable wick material. In addition, a deposit 38 of vaporizable material such as water, alcohol or the like is disposed within tubing 33 under partial vacuum whereby heating of the sidewall of tubing 33 in the region of deposit 38 causes deposit 38 to vaporize. The vapors move upwardly to the condensing end of tubing 33 adjacent cooling fins 34. Accordingly, heat tube assembly 32 is disposed at an upwardly sloping angle within housing 31.

Clamping means for variably gripping heat tube assembly 32 within housing 31 includes the bifurcated lower end portions *29a, 29b* spaced apart to form a slot 30 or gap extending along the length of housing 31 as well as extending outwardly from housing 31 to the periphery of body portion. As thus arranged, portions *29a, 29b* form gripping means capable of being drawn together by means of the screws 39 which interconnect the two portions *29a, 29b* for adjustably tightening them against the periphery of tubing 33.

As thus arranged, intimate heat conductive contact is made between the exterior of tubing 33 and the interior peripheral surface of housing 31 so as to provide substantial heat conductivity between the contents of heat tube 32 and heat sink 29.

As thus arranged, and in operation, upon subjecting unit 14 to a high energy beam represented by phantom line 18, a heat absorbing element such as polarizing element 11 will become heated. However, the two sapphire windows 12, 13 drain the heat away from polarizing element 11 and transfer the heat via edge margins 27 of windows 12, 13 to the first body portion 21 of mounting body 19. Body portion 21 is integral with the heat sink body portion 29 whereby heat applied to first body portion 21 will be readily conducted into heat sink 29 to be transferred to heat tube 32 as noted above.

With heat tube assembly 32 disposed in housing 31 to extend at an upwardly inclined angle to the horizontal (FIG. 4), application of heat from heat sink 29 to the contents of cylindrical tubing 33 causes deposit 38 to become vaporized or converted to the gaseous state and pass upwardly within tubing 33. The upper end of tubing 33 adjacent cooling fins 34 serves to condense the gas or vapor in response to cooling of fins 34 by suitable means, such as the flow of air or otherwise. As the vapor condenses, the moisture is drawn back downwardly along the sidewalls of tubing 33 by means of the wick material 37. Tubing 33 is sufficiently long so as to dispose fins 34 well clear of body 19 so as to permit an airflow across fins 34 without affecting the function of tube assembly 32.

The foregoing condensing action continuously transfers heat away from heat sink 29.

While heat tube 32 can be readily inserted into housing 31, other heat tube units may have an enlarged protuberance or flange or the like on one end with the cooling fins being disposed on the other. Since both ends of the heat tube unit, as thus arranged, make it difficult to employ a mounting construction of the type shown in FIG. 5, an additional embodiment as shown in FIGS. 6, 7, 8 and 9 serves to permit the mounting of a heat tube unit laterally from the side, i.e., which is not required to be longitudinally passed through the length of mounting housing 31.

Accordingly, the lower end 41 of a heat tube unit 42 has been diagrammatically shown and represented in FIG. 8 wherein an enlargement is carried on the lower end of the heat tube unit 42 which would prevent the heat tube 42 from being longitudinally passed downwardly through the open housing 31.

Accordingly, the first body portion 43 and retaining plate 44 support an optical unit 14 in the manner described above. The heat sink portion 46 includes an elongate housing 47 formed with an elongate side opening 48 substantially as wide as the diameter of housing 47 whereby heat tube unit 42 can be laterally moved through opening 48 and into housing 47. The diameter of housing 47 and unit 42 should be substantially equal to provide maximum heat transfer contact therebetween.

The second body portion or heat sink portion 46 includes a separable gripping part such as a chuck 49 formed to include a portion *49a* of the interior periphery of housing 47.

Screws 51 move chuck 49 between retracted and advanced positions relative to the axis of housing 47 to press heat tube unit 42 tightly against the periphery of housing 47 in effective heat transfer relation therebetween.

From the foregoing it will be readily evident that there has been provided improved means for gripping a heat tube in efficient energy transfer relation therebetween whereby the heat tube serves to cool a heat sink associated with an energy absorbant optical unit.

What is claimed is:

1. A cooling device for protecting a light absorbing optical element of the type which becomes heated when subjected to a beam of light, the cooling device comprising:

(a) an optical unit which includes a transparent, thermally-conductive material disposed in heat conductive relation to the optical element to dissipate heat from the optical element;

(b) a mounting body for supporting the optical unit and disposed in heat conductive relation thereto for receiving heat energy from the thermally-conductive material; and (c) heat dissipating means for removing heat from the mounting body including a first energy transfer portion disposed within the mounting body for receiving heat-energy therefrom and a second energy transfer portion disposed in thermal communication with the first energy transfer portion and outside the mounting body.

2. A cooling device as in claim 1 wherein the transparent, thermally-conductive material is sapphire.

3. A cooling device as in claim 2 wherein the optical element is a polarizing element.

4. A cooling device as in claim 1 wherein the optical unit comprises a polarizing element disposed between a pair of sapphire windows.

5. A cooling device as in claim 4 wherein index matching oil is disposed between confronting surfaces of the polarizing element and the sapphire windows to establish heat conductive contact between the confronting surfaces.

6. A cooling device for protecting a light absorbing optical element of the type which becomes heated when subjected to a beam of light, the cooling device comprising:

(a) an optical unit comprising a pair of sapphire windows with the optical element disposed between the sapphire windows in heat conductive relation thereto such that heat energy is transferred from the optical element to the sapphire windows;

(b) a heat conductive mounting body for supporting the optical unit and disposed in heat conductive relation thereto such that heat is transferred from the sapphire windows to the mounting body; and (c) a heat pipe comprising a first energy transfer portion disposed within the mounting body such that heat energy is transferred from the mounting body to the first portion and a second energy transfer portion disposed in thermal communication with the first portion and disposed outside the mounting body such that heat energy is removed from the optical element and transferred to ambient via the sapphire windows, mounting body and heat pipe.

7. A cooling device as in claim 6 wherein the optical element is a polarizing element.

8. A cooling device as in claim 6 wherein index matching oil is disposed between confronting surfaces of the polarizing element and the sapphire windows to establish heat conductive contact between the confronting surfaces.

9. A cooling device as in claim 6 wherein the mounting body comprises aluminum.

* * * * *